US009126732B2

(12) United States Patent
DeBerry et al.

(10) Patent No.: US 9,126,732 B2
(45) Date of Patent: Sep. 8, 2015

(54) RETAINED TENSION METAL LOCKING TIE AND PNEUMATIC HAND TOOL

(75) Inventors: Earl J. DeBerry, Joliet, IL (US); John J. Bulanda, New Lenox, IL (US); James R. Ward, Naperville, IL (US); Lawrence A. Hillegonds, New Lenox, IL (US)

(73) Assignee: Panduit Corp., Tinley Park, IL (US)

( * ) Notice: Subject to any disclaimer, the term of this patent is extended or adjusted under 35 U.S.C. 154(b) by 619 days.

(21) Appl. No.: 13/463,242

(22) Filed: May 3, 2012

(65) Prior Publication Data

US 2012/0279018 A1 Nov. 8, 2012

Related U.S. Application Data

(60) Provisional application No. 61/483,301, filed on May 6, 2011.

(51) Int. Cl.

| | |
|---|---|
| ***B65D 63/08*** | (2006.01) |
| ***B65B 13/02*** | (2006.01) |
| ***B25B 27/14*** | (2006.01) |

(52) U.S. Cl.

CPC ..... *B65D 63/08* (2013.01); *B25B 27/146* (2013.01); *B65B 13/027* (2013.01); *Y10T 24/1459* (2015.01)

(58) Field of Classification Search

CPC .... B65B 13/027; B25B 27/146; B65D 63/02; B65D 63/04; B65D 63/06; B65D 63/08

USPC ..... 140/93.2, 93.4, 93 A, 123.6; 24/20 R, 21, 24/25

See application file for complete search history.

(56) References Cited

U.S. PATENT DOCUMENTS

| | | | |
|---|---|---|---|
| 3,661,187 | A | 5/1972 | Caveney et al. |
| RE29,973 | E | 4/1979 | Paradis |
| 4,366,602 | A | 1/1983 | Conlon et al. |
| 4,399,592 | A | 8/1983 | Chopp, Jr. et al. |
| 4,410,019 | A | 10/1983 | Suzuki |
| 4,548,242 | A | 10/1985 | Paradis |
| 4,930,548 | A | 6/1990 | Turek et al. |
| 5,065,798 | A | 11/1991 | Alletto et al. |
| 5,230,129 | A | 7/1993 | Scruggs |
| 5,291,637 | A | 3/1994 | Meyers |
| 5,345,663 | A | 9/1994 | Scruggs |
| 5,732,446 | A | 3/1998 | Blanks |
| 5,850,674 | A | 12/1998 | Jansen |

(Continued)

FOREIGN PATENT DOCUMENTS

WO 2008150990 A1 12/2008

*Primary Examiner* — Teresa M Ekiert

(74) *Attorney, Agent, or Firm* — Christopher S. Clancy; Aimee E. McVady

(57) ABSTRACT

The present invention is directed to a metal locking tie and a metal locking tie tool. The metal locking tie has a tie body, a tie head secured to the tie body, and a roller means disposed in the tie head. The tie head has a bottom, a ceiling, opposing sides, a strap entrance end and a strap exit end that define a strap receiving passageway therethrough. The tie head also includes an angled tool bearing surface at the strap exit end. The metal locking tie tool includes a cutter cap with a cutter and a ball setter. Once the metal locking tie tool has tensioned the metal locking tie, the cutter moves linearly with respect to the cutter cap to set the roller means in the tie head and to provide a flush cut off of the excess tie body from the metal locking tie.

18 Claims, 16 Drawing Sheets

(56) References Cited

U.S. PATENT DOCUMENTS

| | | | |
|---|---|---|---|
| 6,076,235 | A | 6/2000 | Khokhar |
| 6,122,804 | A | 9/2000 | Gamaggio-Schäfer |
| 6,477,746 | B1 | 11/2002 | Axelsson |
| 6,647,596 | B1 | 11/2003 | Caveney |
| 6,668,427 | B2 | 12/2003 | Bulanda et al. |
| 7,124,787 | B2 | 10/2006 | Lueschen |
| 7,302,737 | B2 | 12/2007 | Bae |
| 7,409,749 | B2 | 8/2008 | Caveney |
| 7,438,094 | B2 | 10/2008 | Hillegonds et al. |
| 7,458,398 | B2 | 12/2008 | Hillegonds et al. |
| 7,591,451 | B2 | 9/2009 | Dyer et al. |
| 7,669,293 | B2 | 3/2010 | Huang |
| 7,930,805 | B2 | 4/2011 | Bulanda |
| 8,225,461 | B2 | 7/2012 | Bulanda et al. |

RETAINED TENSION METAL LOCKING TIE AND PNEUMATIC HAND TOOL

CROSS-REFERENCE TO RELATED APPLICATION

This application claims priority to U.S. Provisional Application No. 61/483,301, filed May 6, 2011, the subject matter of which is hereby incorporated by reference in its entirety.

FIELD OF THE INVENTION

The present invention relates to a metal locking tie, and more particularly to a metal locking tie having an angled tool bearing surface and a pneumatic hand tool for installing the metal locking tie.

BACKGROUND OF THE INVENTION

Metallic bundling devices, such as cable ties, which incorporate locking devices or mechanisms, such as balls or roller pins, have been used for bundling a great variety of items, such as bales of cotton, since the Nineteenth Century. However, such devices were not "positive" locking; that is, such devices could not adjust for the situation in which gravity would prevent or urge the ball out of locking engagement with the strap, resulting in the release of the cable ties, and, consequently, the items intended to be restrained.

U.S. Pat. No. 4,399,592 to Chopp, Jr., et al. addressed this initial problem by teaching the addition of a raised portion or protuberance for deflecting the threaded strap away from the floor, as the threaded strap exits the locking head. This deflection ensures that the locking device is in continuous engagement with the threaded strap, regardless of the position of the locking device or the orientation of the locking head.

Now, it would be desirable to provide a metal locking tie with a consistent shear surface that enables a tool to cut-off excess strap flush with the locking head.

SUMMARY OF THE INVENTION

The present invention is directed to a metal locking tie with a consistent shear surface that enables a metal locking tie tool to cut-off excess strap flush with the metal locking tie. The metal locking tie includes a tie body, a tie head secured to the tie body, and a roller means disposed in the tie head for lockingly engaging the tie body. The tie head has a bottom, a ceiling, a first side, a second side, a strap entrance end, and a strap exit end that define a strap receiving passageway therethrough. The tie head also has an angled tool bearing surface at the strap exit end adjacent each side of the strap receiving passageway for creating the consistent shear surface for the metal locking tie tool.

DETAILED DESCRIPTION

Figure 1:
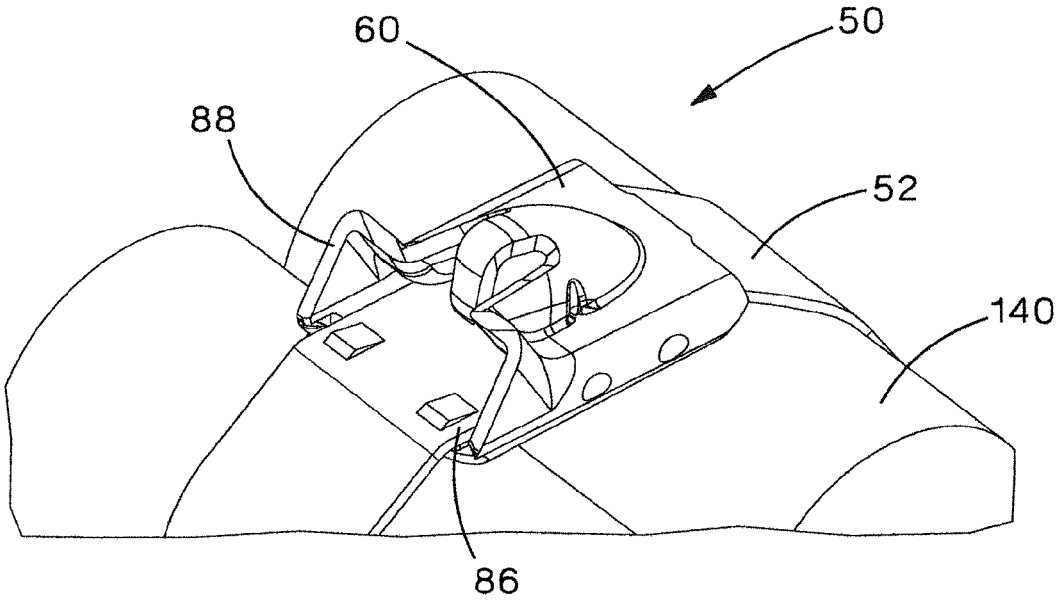
FIG. 1 is a perspective of a metal locking tie of the present invention.
Figure 2:
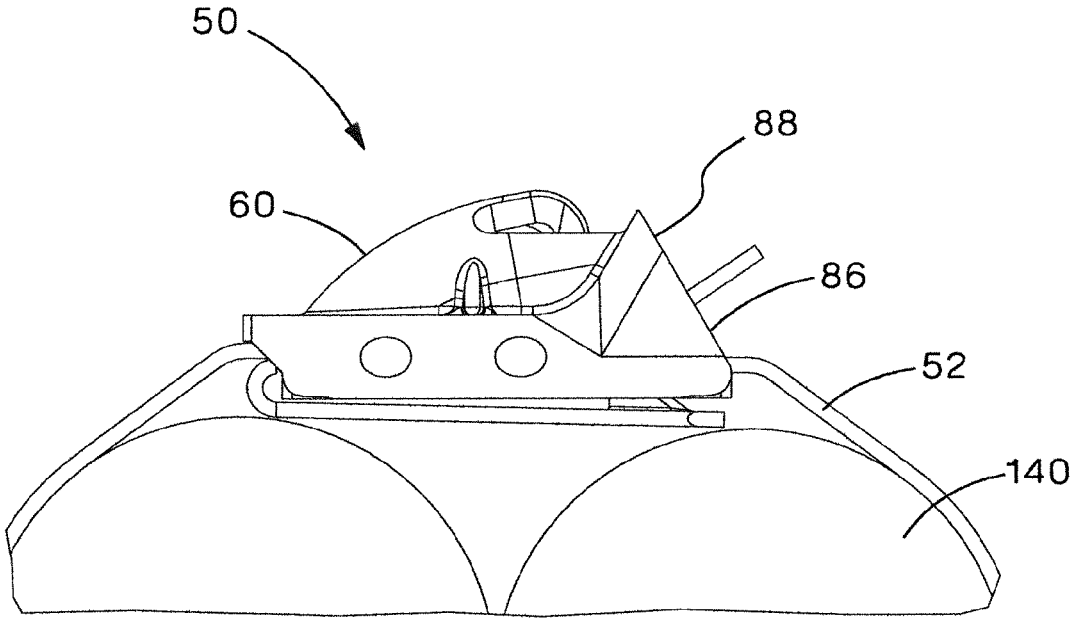
FIG. 2 is a side view of the metal locking tie of FIG. 1.

FIG. 1 illustrates the metal locking tie 50 of the present invention. FIG. 2 illustrates a side view of the metal locking tie 50 positioned around a bundle 140. The metal locking tie 50 includes a tie body or strap 52 and a tie head 60. The tie head 60 includes a flared exit end 86 that accommodates the tie body 52 thread through the tie head 60. As discussed below, the flared exit end 86 also provides an angled tool bearing surface 88 for the pneumatic hand tool 120 used to install the metal locking tie 50 (see FIGS. 6-7 and 11-12). As a result, the tie head 60 provides a consistent shear surface for the tool 120 to provide a flush cut-off of the excess tie body 52.

Figure 3:
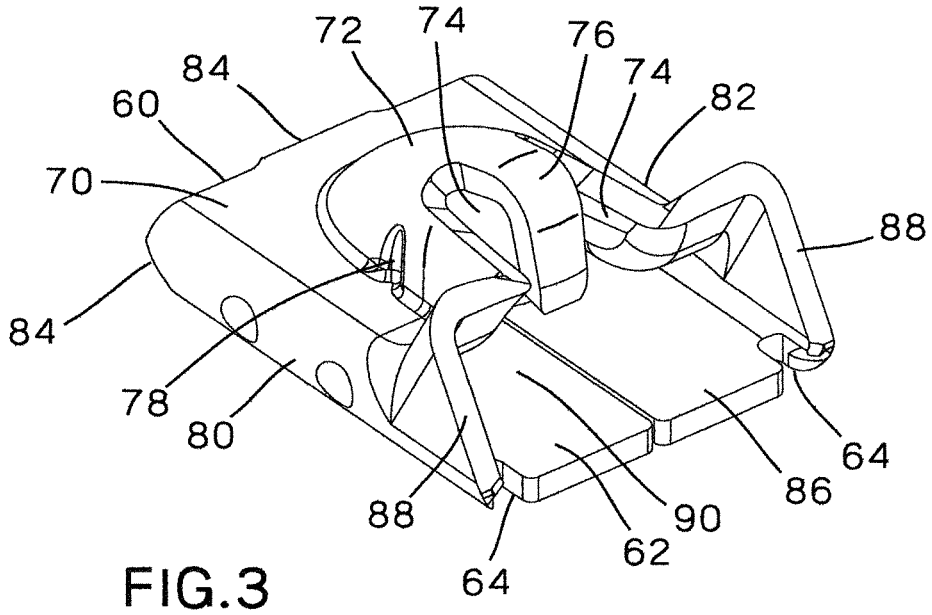
FIG. 3 is a perspective view of a first embodiment of the metal locking tie head of the metal locking tie of FIG. 1.
Figure 4:
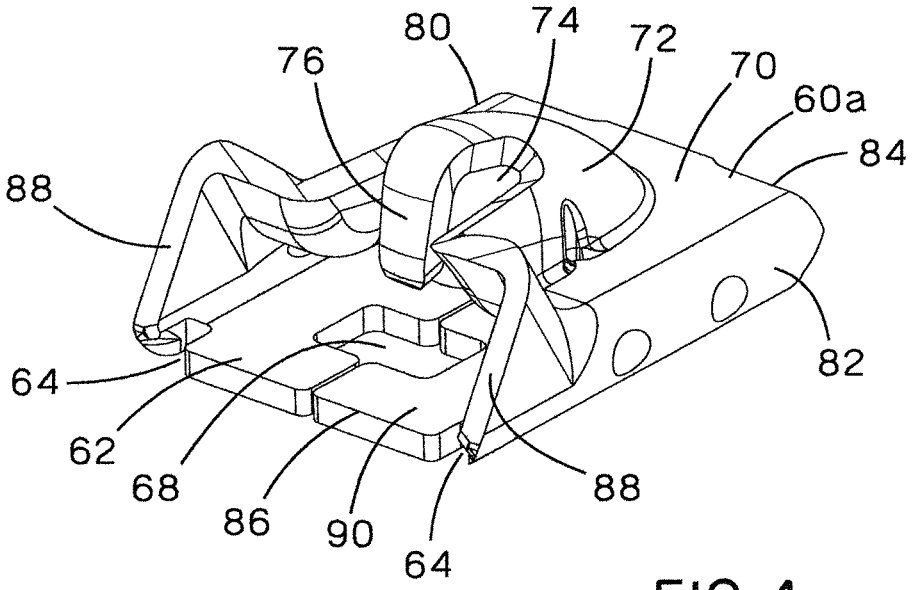
FIG. 4 is a perspective view of a second embodiment of the metal locking tie head of the metal locking tie of FIG. 1.

FIGS. 3 and 4 illustrate a first and second embodiment of the tie head 60, respectively. The tie head 60 includes a bottom floor 62, a ceiling 70, a hood or roof 72, a first side 80, a second side 82, a strap entrance end 84, a strap exit end or flared exit end 86 and a strap receiving aperture or passageway 90 therethrough. The corners of the bottom floor 62 include relief slots 64.

The hood 72 includes ball retainer tab cutouts 74 that form a tab 76 to retain the roller means or ball 92 positioned within the tie head 60. The hood 72 is positioned closer to the strap entrance end 84 to enable the angled tool bearing surface 88 to be formed. The ball retainer tab cutouts 74 in the tie head 60 are deeper than cutouts in prior art metal locking tie heads to create a deeper linear opening for the pneumatic hand tool 120 to set the roller means 92 without having the tool 120 enter the inside of the hood 72. The tab 76 in the tie head 60 is shorter than prior art metal locking tie heads to allow for clearance of the new angled tool bearing surfaces 88 without impacting the strap receiving passageway 90 or threading the tie body 52 through the strap receiving passageway 90. As illustrated in FIGS. 3 and 4, the tab 76 is bent downwards such that the tab 76 extends generally vertical toward the bottom floor 72.

Each side of the hood 72 may include a dimple 78. The dimples 78 create a resistance with the roller means 92 until a predetermined tension is reached on the tie body 52. The dimples 78 enable the minimum strap tension to be reached prior to the roller means 92 being set in the metal locking tie 50.

As discussed above, the strap exit end 86 of the tie head 60 includes angled tool bearing surfaces 88. An angled tool bearing surface 88 is located on the tie head 60 adjacent each side of the strap passageway 90. The angled tool bearing surface 88 allows the pneumatic hand tool 120 to pivot away from the bundle surface thereby producing a more consistent flush cut-off of the tie body 52.

As illustrated in FIG. 4, the second embodiment of the tie head 60*a* is identical to the tie head 60 except for the window 68 in the bottom floor 62.

Figure 5:
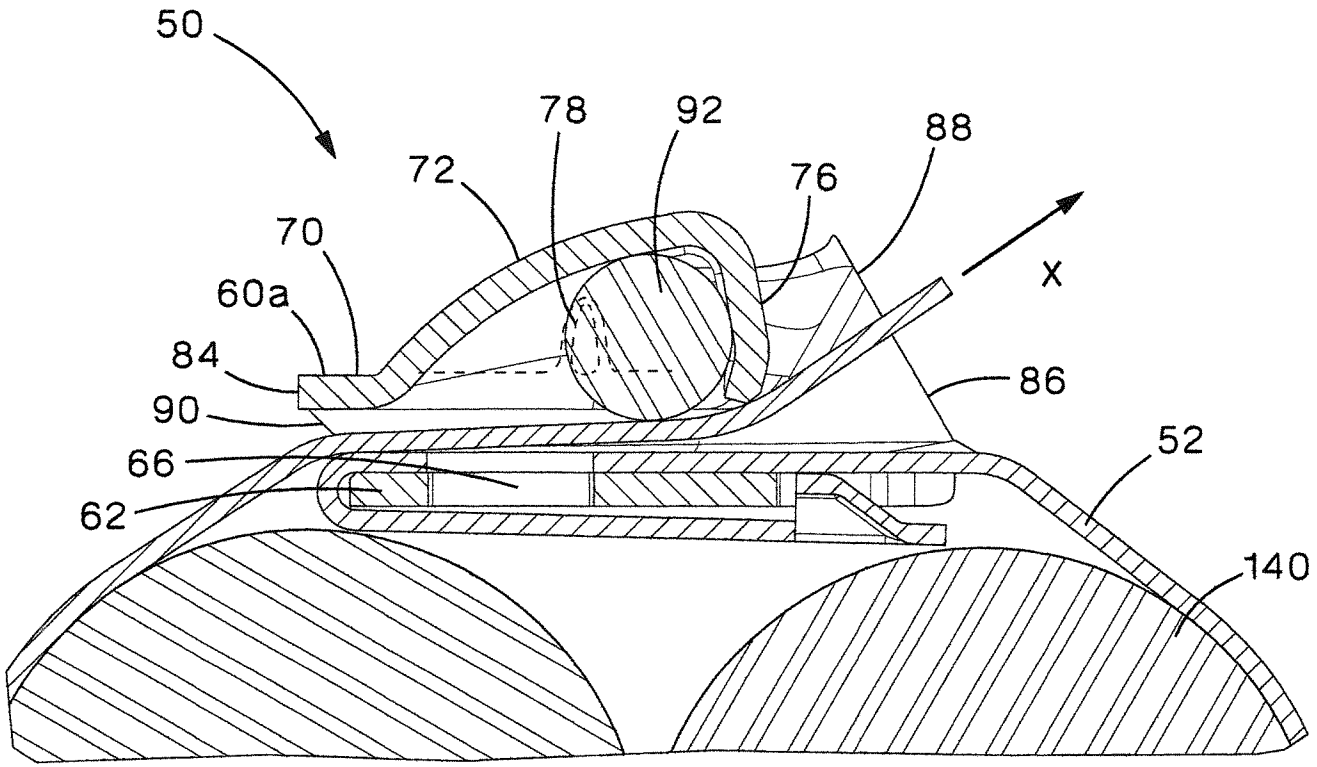
FIG. 5 is a partial cross sectional view of the metal locking tie head being installed around a bundle.

FIG. 5 illustrates a partial cross sectional view of the metal locking tie 50 positioned to be installed around a bundle 140. The tie body 52 has been wrapped around a bundle 140 and threaded through the tie head 60*a*. The tie body 52 is tensioned in the "X" direction, as illustrated by the arrow in FIG. 5, to a predetermined load. The dimples 78 along the sides of the hood 72 retain the roller means 92 in the highest position in the tie head 60*a* during tensioning.

Figure 6:
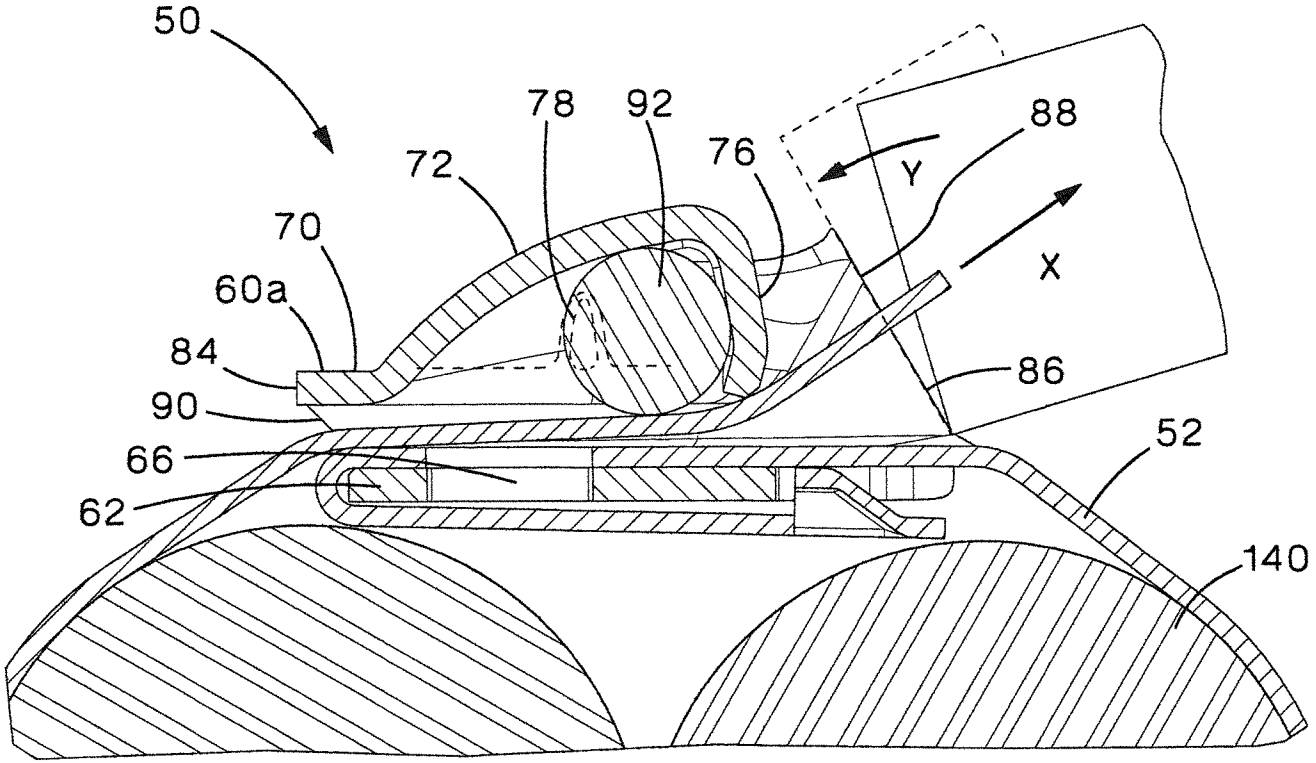
FIG. 6 is a partial cross sectional view of the metal locking tie of FIG. 5 being tensioned around a bundle as the installation tool engages the tie.

FIG. 6 illustrates a partial cross sectional view of the metal locking tie 50 positioned around the bundle 140 with an installation tool engaging the tie head 60*a*. The installation tool begins to engage the tie head 60*a* while the tie body 52 is being tensioned. The angled tool bearing surfaces 88 of the tie head 60*a* force the installation tool to consistently pivot and seat in the "Y" direction, as illustrated by the arrow in FIG. 6, on the angled tool bearing surfaces 88.

Figure 7:
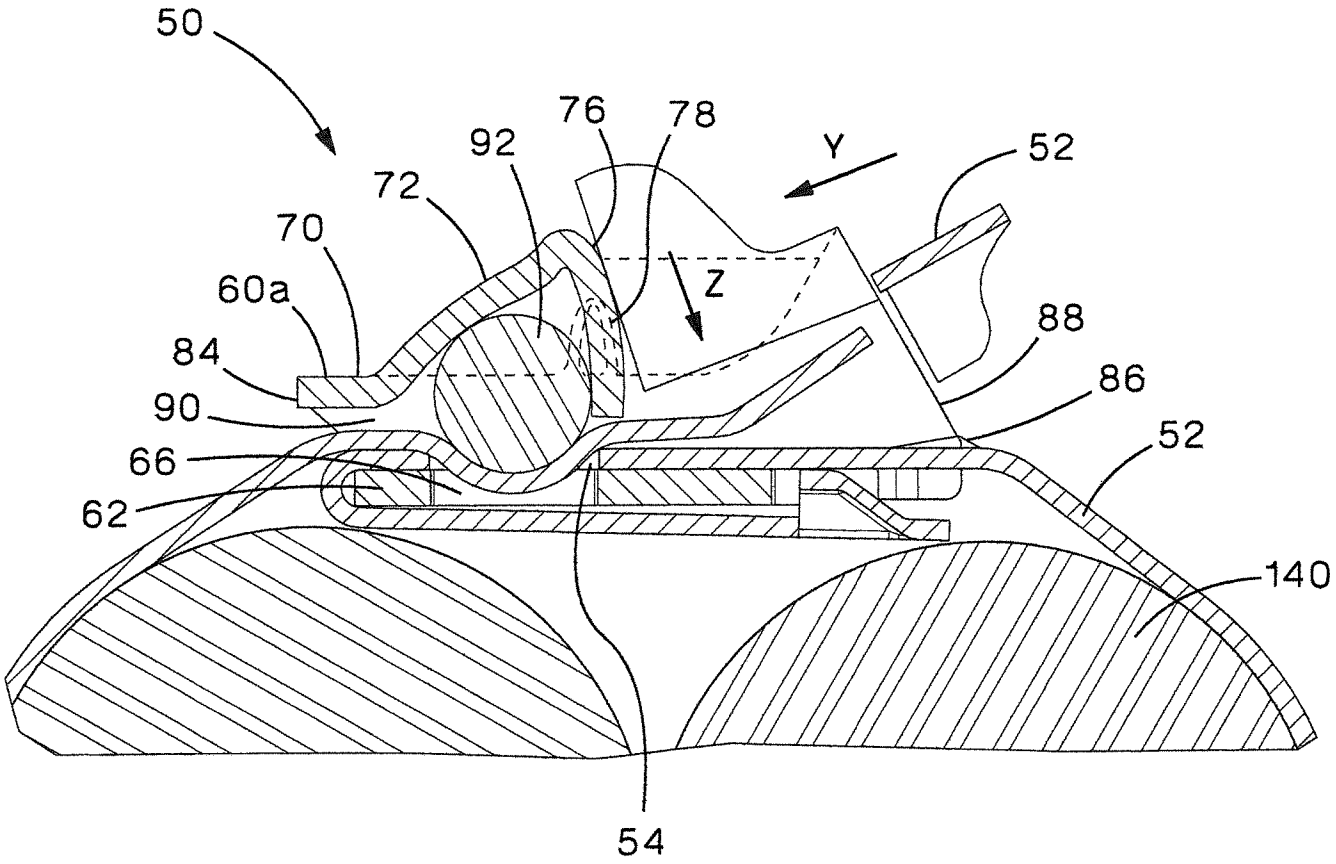
FIG. 7 is a partial cross sectional view of the metal locking tie of FIG. 5 installed around a bundle as the tool completes installation.

FIG. 7 illustrates a partial cross sectional view of the metal locking tie 50 positioned around a bundle 140 with the roller means 92 set in the tie head 60*a* and the excess tie body 52 cut-off. As the predetermined tension on the tie body 52 is being obtained, the ball set feature on the installation tool engages the tie head 60*a*. The ball set feature on the installation tool engages the tab 76 to set the roller means 92 and to displace the tie body 52 into the displacement holes 54, 66 within the tie body 52 and the tie head 60*a*, respectively. As illustrated in FIG. 7, the cutter blade moves downward in a "Z" direction to shear the tie body 52 against the stationary shear edge of the installation tool. The installation tool may then be disengaged from the metal locking tie 50 to leave an optimum mechanical lock between the roller means 92 and the tie body 52 with a retained tension on the bundle 140.

Figure 8:
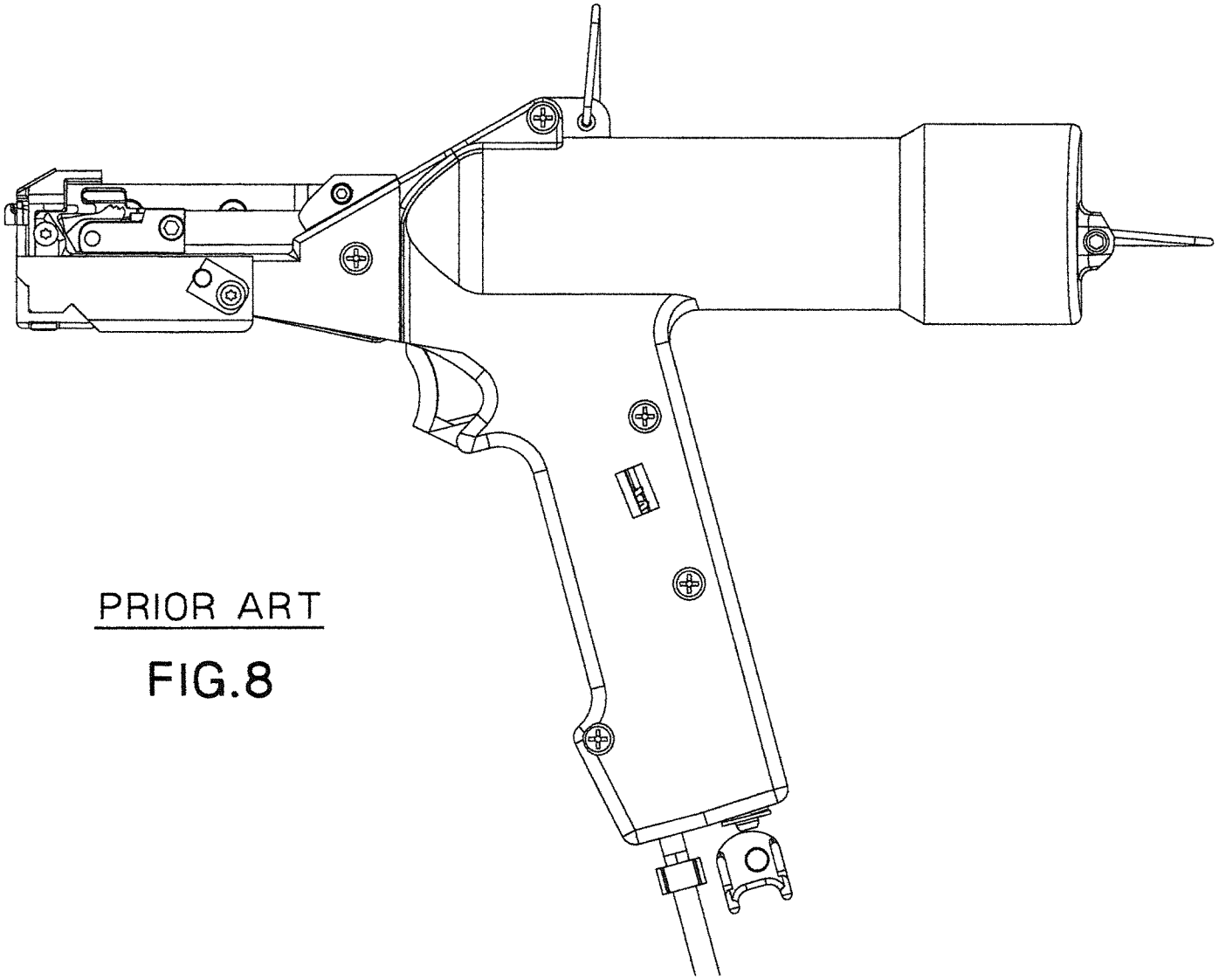
PRIOR ART FIG.8
FIG. 8 is a side view of a prior art pneumatic hand tool.

FIG. 8 illustrates a side view of a prior art pneumatic hand tool PPTMT sold by Panduit Corp., the assignee of the present invention. The pneumatic hand tool 120 of the present invention is based on the frame of the tool illustrated in FIG. 8. FIGS. 9-12 specifically illustrate the front of the new pneumatic hand tool 120 used to tension the metal locking tie 50 of the present invention. The new pneumatic hand tool 120 includes a modified blade guard housing 122, cutter cap 124 and cutter 132.

Figure 9:
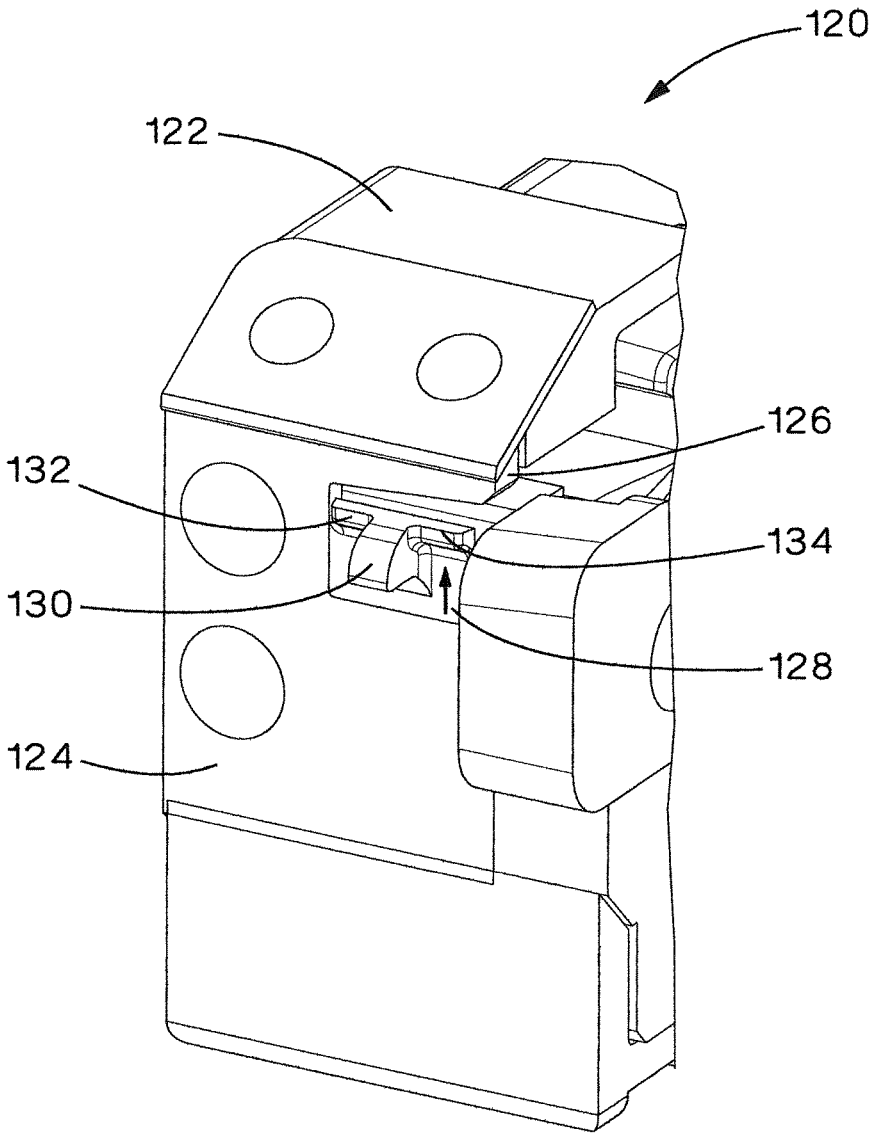
FIG. 9 is a front perspective view of the blade guard housing to be used with the pneumatic hand tool of FIG. 8 with the cutter block positioned in a before cut position.
Figure 10:
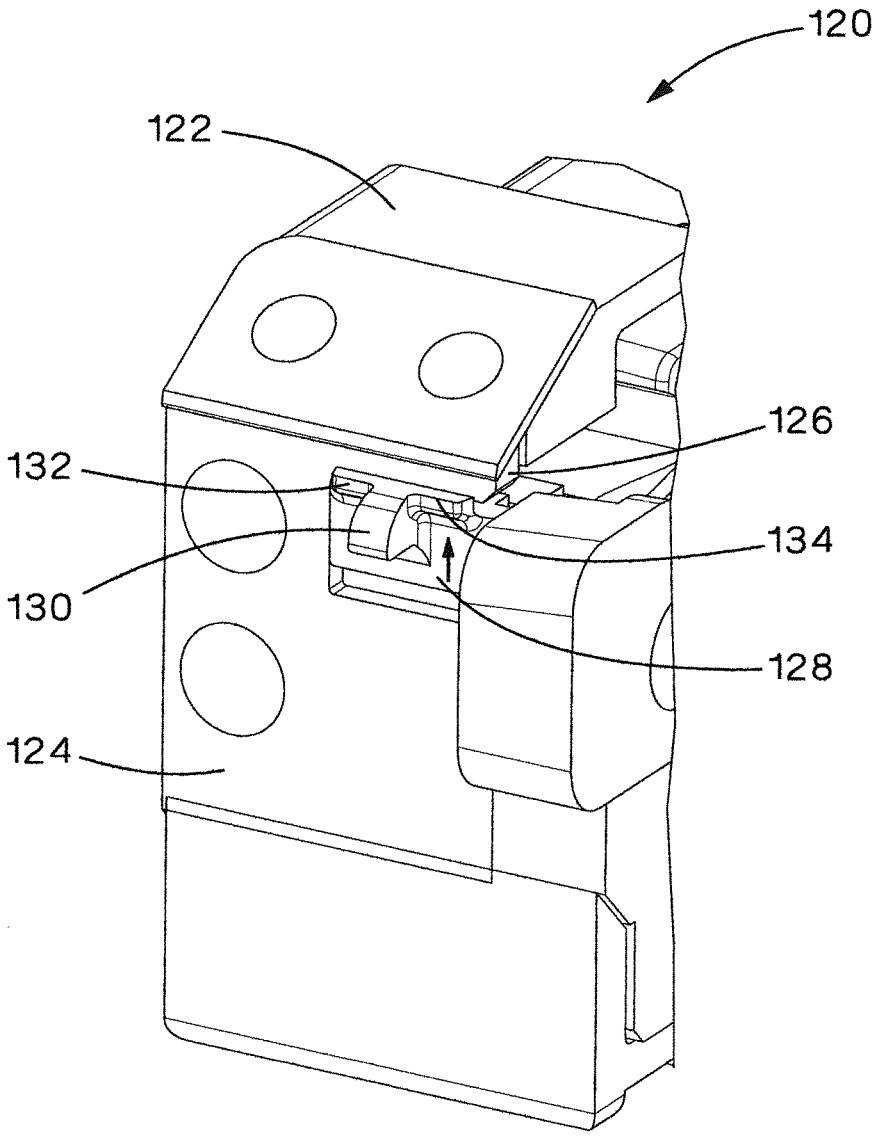
FIG. 10 is a front perspective view of the blade guard housing of FIG. 9 with the cutter block positioned in an after cut position.

As illustrated in FIGS. 9 and 10, the blade guard housing 122 includes a cutter cap 124 having an anvil cutting surface 126 and a cutter block 128. The cutter block 128 includes an outwardly extending ball setter 130 and a cutter 132 with a cutter edge 134. FIG. 9 illustrates the ball setter 130 and the cutter 132 in an initial before cut position. The cutter edge 134 can overlap the anvil cutting surface 126 of the cutter cap 124. As illustrated in FIG. 10, the ball setter 130 and the cutter 132 move upwards together in the cutter cap 124 to an after cut position.

Figure 11:
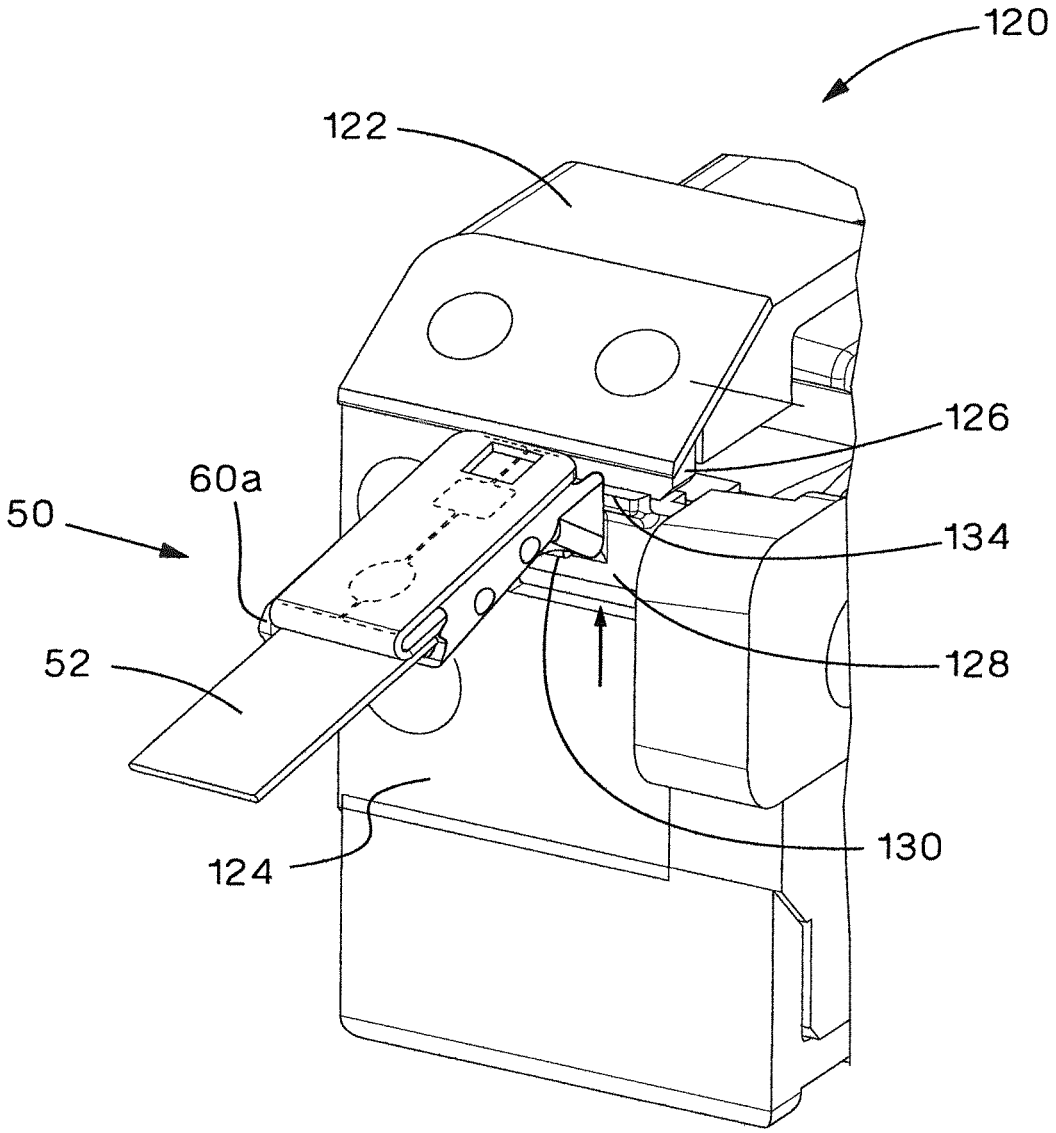
FIG. 11 is the metal locking tie head positioned against the cutter block of the pneumatic hand tool of FIG. 9.

FIG. 11 illustrates the metal locking tie head 60*a* of FIG. 4 positioned against the cutter 132 of the cutter block 128 of the pneumatic hand tool 120 of FIG. 9.

Figure 12:
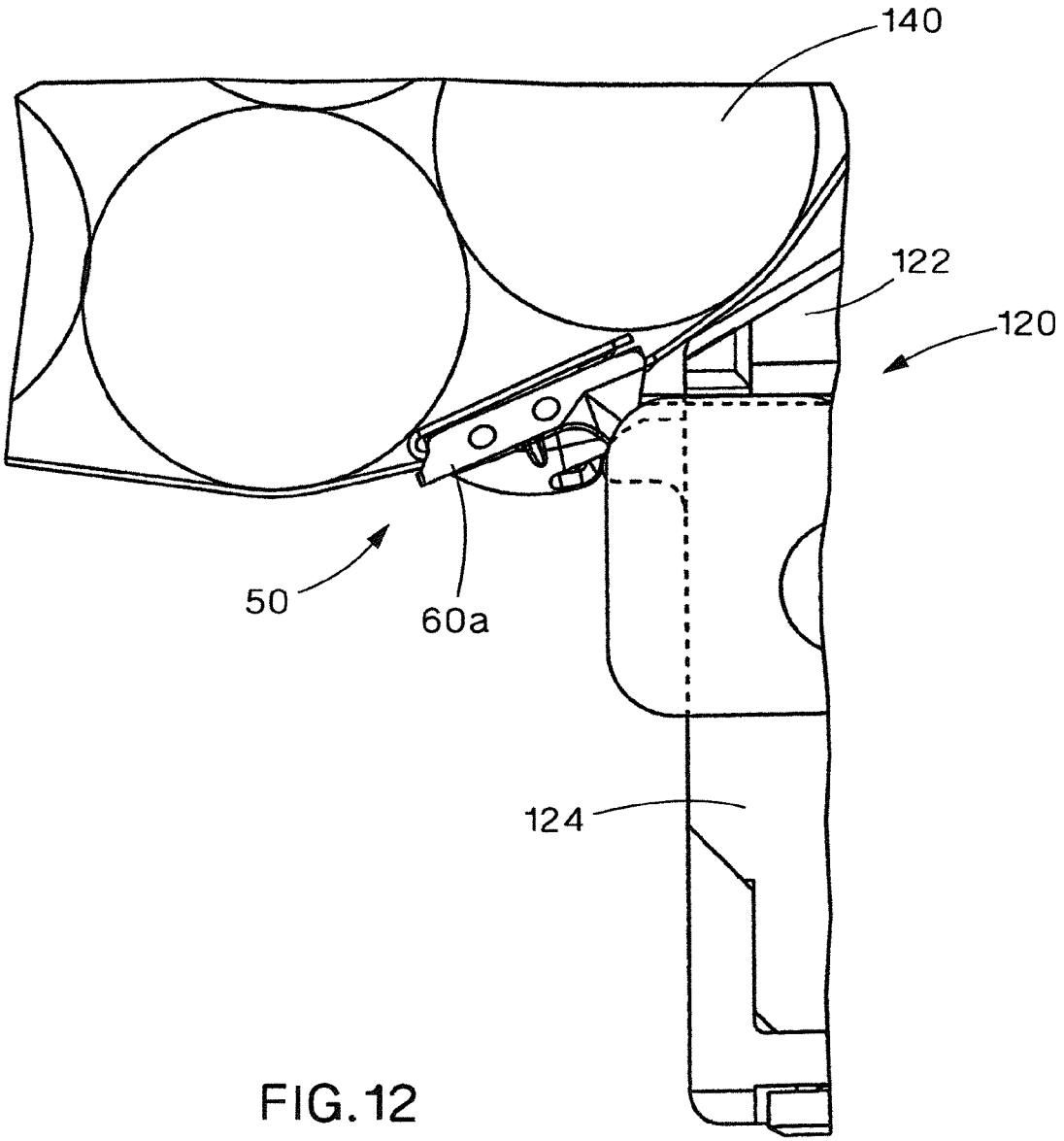
FIG. 12 is a side view of the metal locking tie head positioned in the pneumatic hand tool of FIG. 11 and positioned around a bundle.
Figure 13:
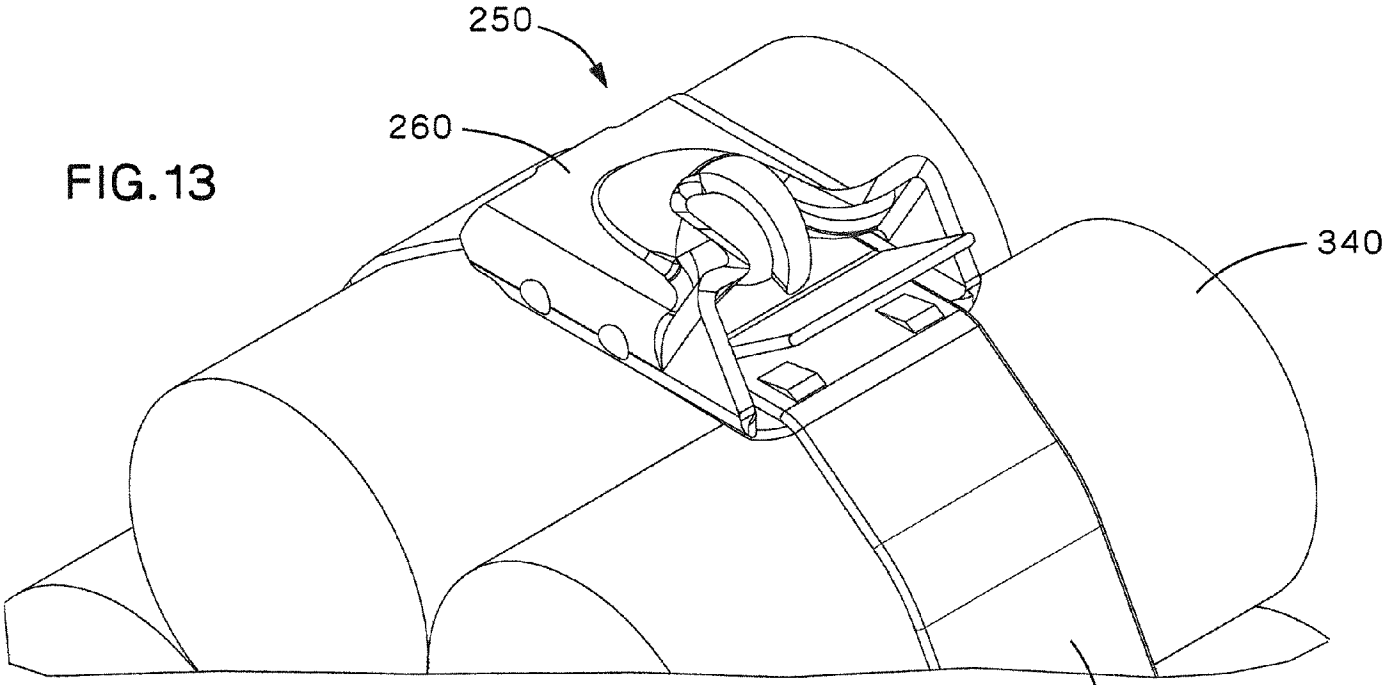
FIG. 13 is a perspective view of an alternative embodiment of the metal locking tie of the present invention.
Figure 14:
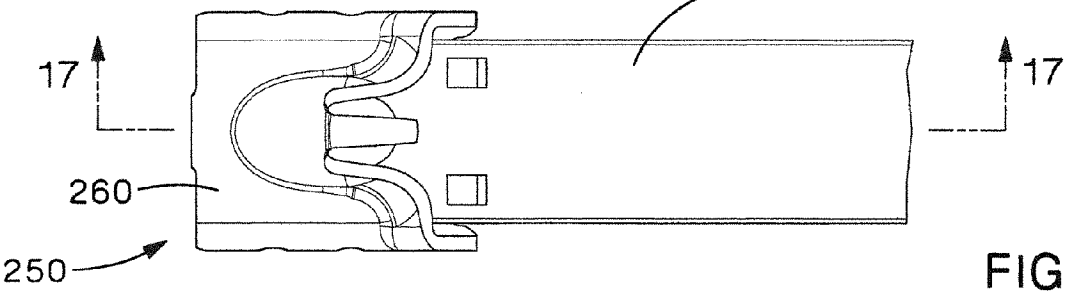
FIG. 14 is a top view of the metal locking tie of FIG. 13.

FIG. 12 illustrates the metal locking tie head 60*a* positioned in the pneumatic hand tool 120 of FIG. 11 positioned around a bundle 140. Due to the configurations of the blade guard housing 122 and the cutter cap 124, the pneumatic hand tool 120 is used to install the metal locking tie 50 on the bottom of the bundle 140. The pneumatic hand tool 120 may be modified to install the metal locking tie 50 on the top of the bundle 140, if desired.

Figure 15:
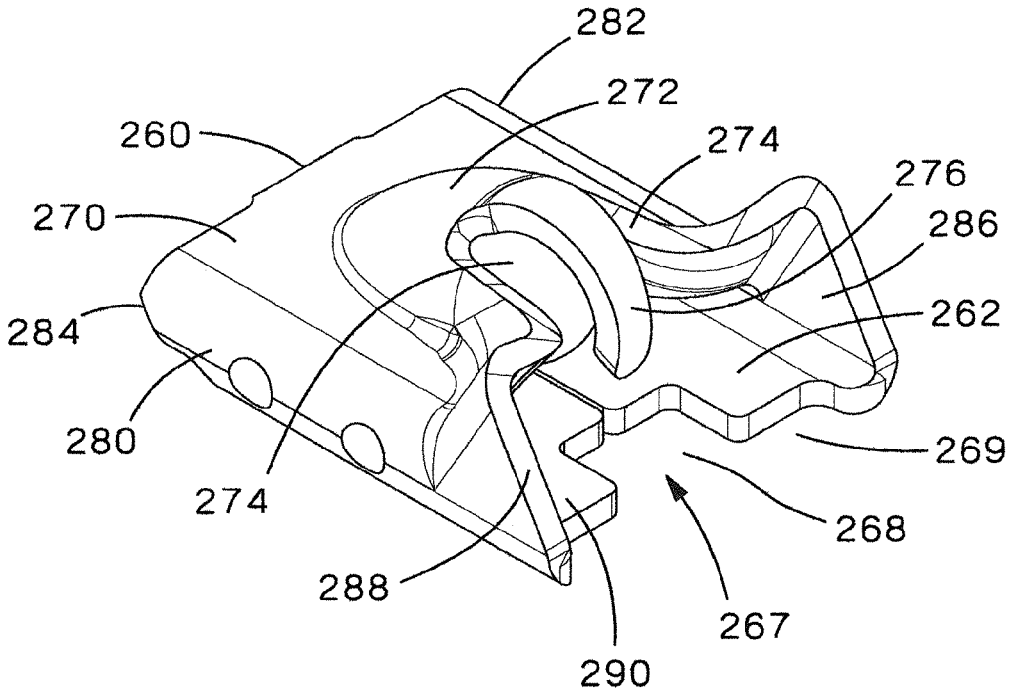
FIG. 15 is a perspective view of the metal locking tie head of the metal locking tie of FIG. 13.
Figure 16:
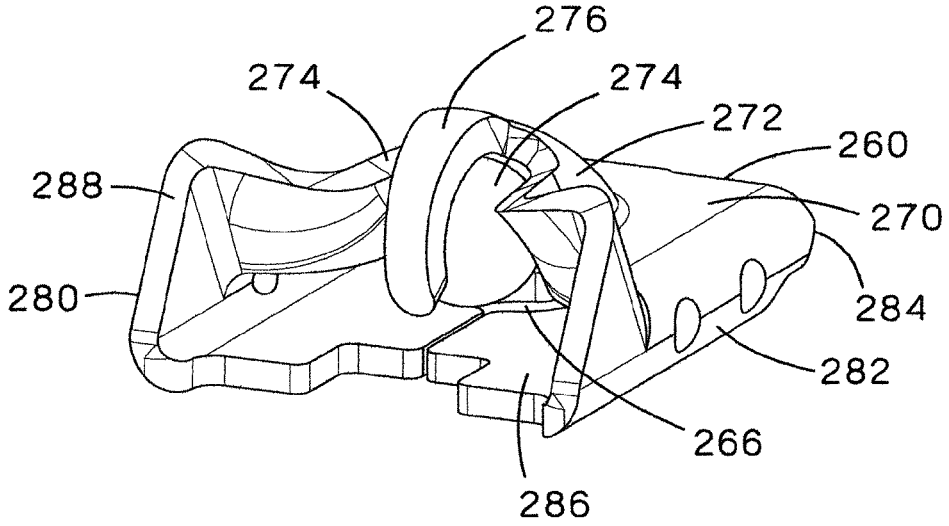
FIG. 16 is a perspective view of the metal locking tie head of the metal locking tie of FIG. 13.
Figure 17:
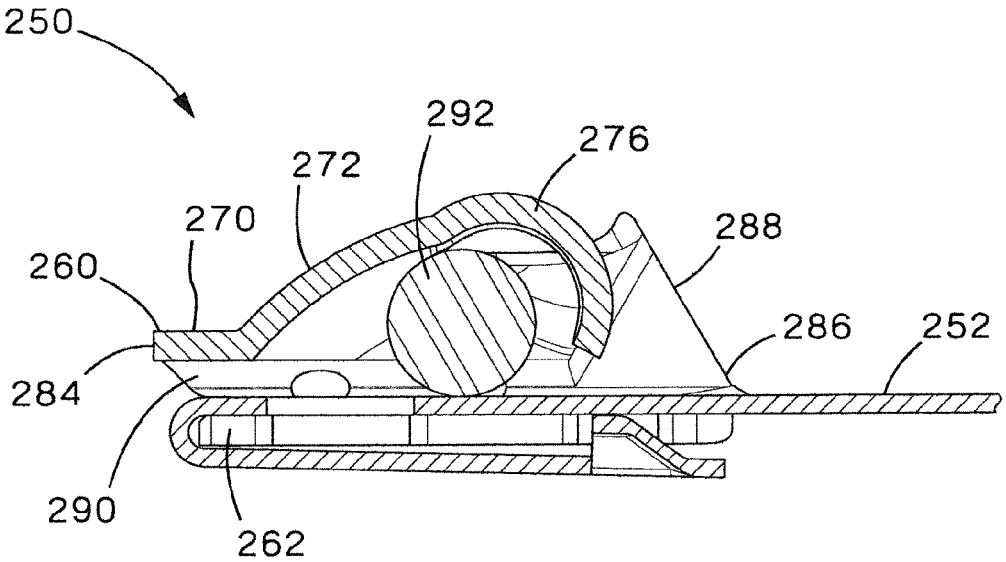
FIG. 17 is a partial cross sectional view of the metal locking tie taken along the line 17-17 of FIG. 14.
Figure 18:
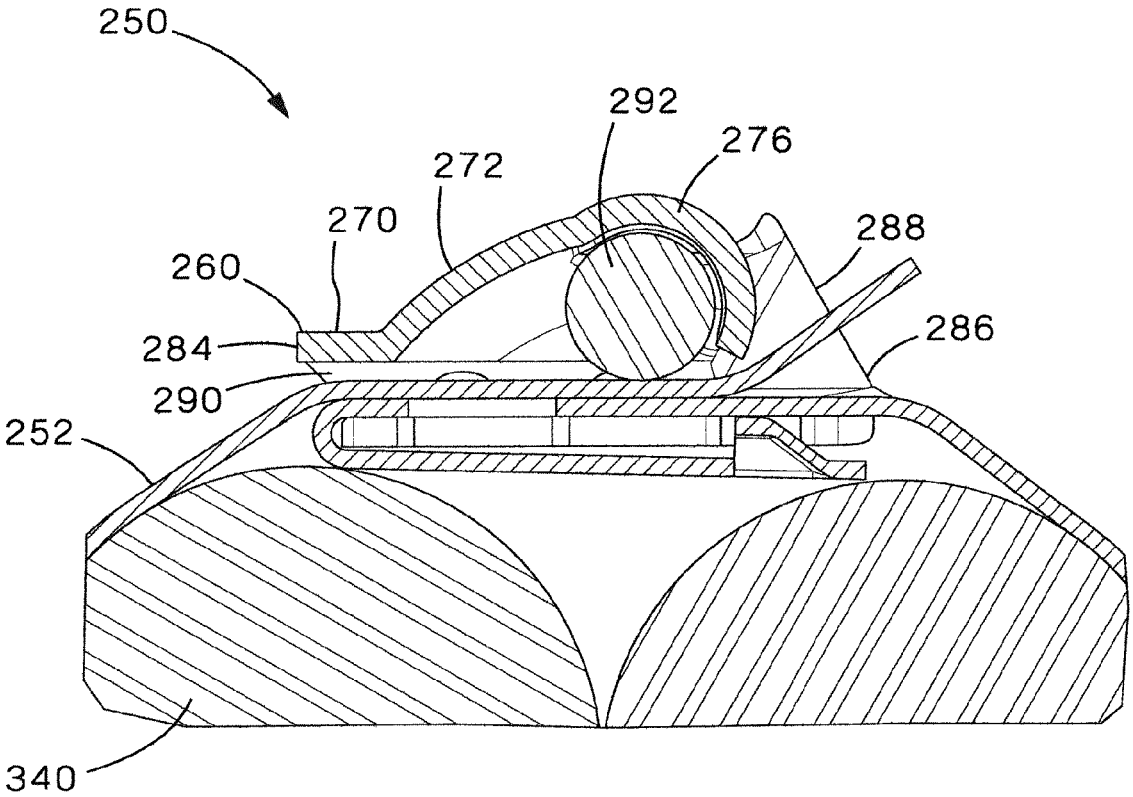
FIG. 18 is a partial cross sectional view of the metal locking tie of FIG. 13 installed around a bundle.

FIGS. 13-21 illustrate an alternative metal locking tie 250 and an alternative blade guard housing 322 for the pneumatic hand tool 320. The alternative metal locking tie 250 includes a tie body or strap 252 and a metal locking tie head 260. As illustrated in FIGS. 15 and 16, the tie head 260 includes a bottom floor 262, a ceiling 270, a hood or roof 272, a first side 280, a second side 282, a strap entrance end 284, a strap exit end or flared exit end 286 and a strap receiving aperture or passageway 290 therethrough.

The bottom floor 262 includes a displacement hole 266 for receiving a roller means 292 and a cut out section 267. The cut out section 267 includes a partial window 268 similar to the window 68 in the second embodiment illustrated in FIG. 4. The cut out section 267 also includes an opening 269 that extends from the first side 280 to the second side 282 of the tie head 260 at the strap exit end 286 of the tie head 260.

The hood 272 includes ball retainer tab cutouts 274 that form a tab 276 to retain the roller means or ball 292 positioned within the tie head 260. The tab 276 is longer than the tab 76 in the metal locking tie heads 60, 60*a* disclosed in FIGS. 1-7. The longer tab 276 is arced such that it is positioned generally over the partial window 268 in the bottom floor 262 as illustrated in FIGS. 15 and 16.

The strap exit end or flared exit end 286 includes an angled tool bearing surface 288. The angled tool bearing surface 288 is located on the tie head 260 adjacent each side 280, 282 of the strap passageway 290. The angled tool bearing surface 288 allows the pneumatic hand tool 320 to engage the tie head 260 to produce a more consistent flush cut-off of the tie body 252.

Figure 19:
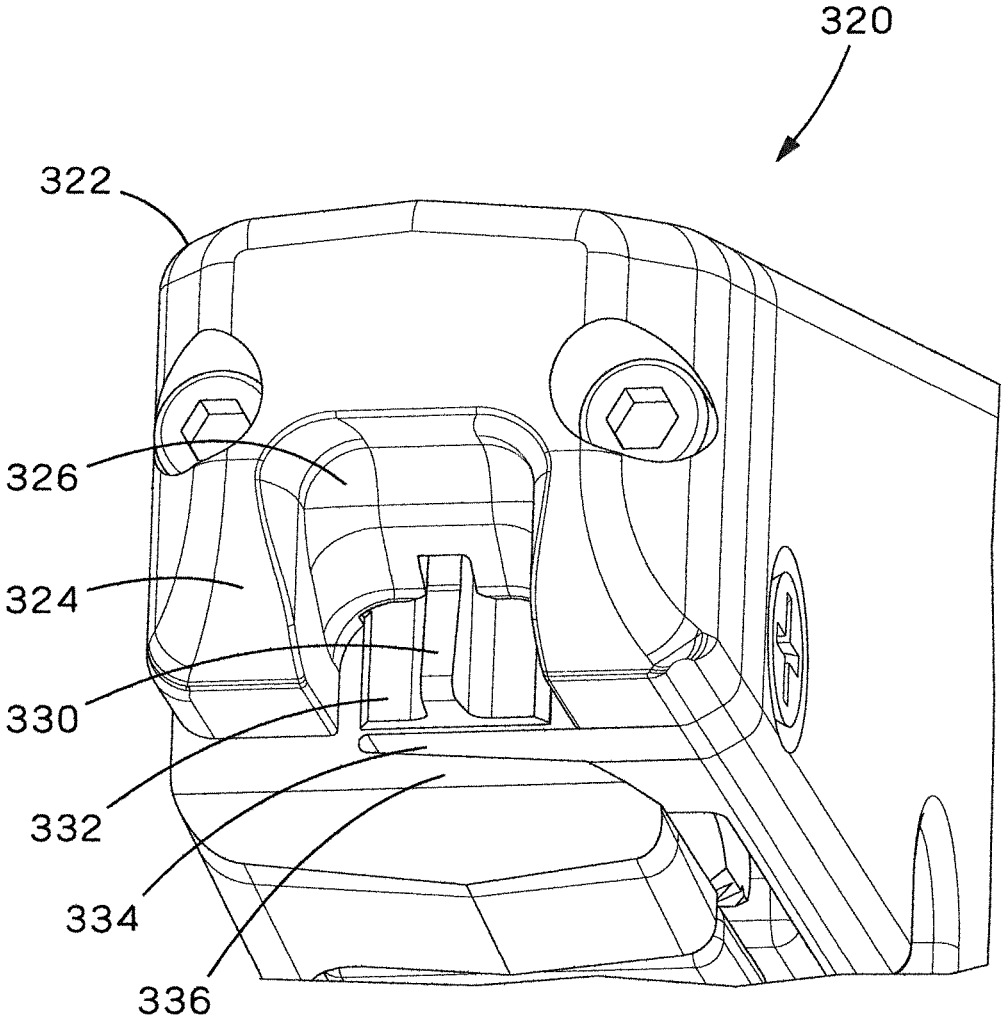
FIG. 19 is a front perspective view of an alternative embodiment of the blade guard housing of the pneumatic hand tool of the present invention.
Figure 20:
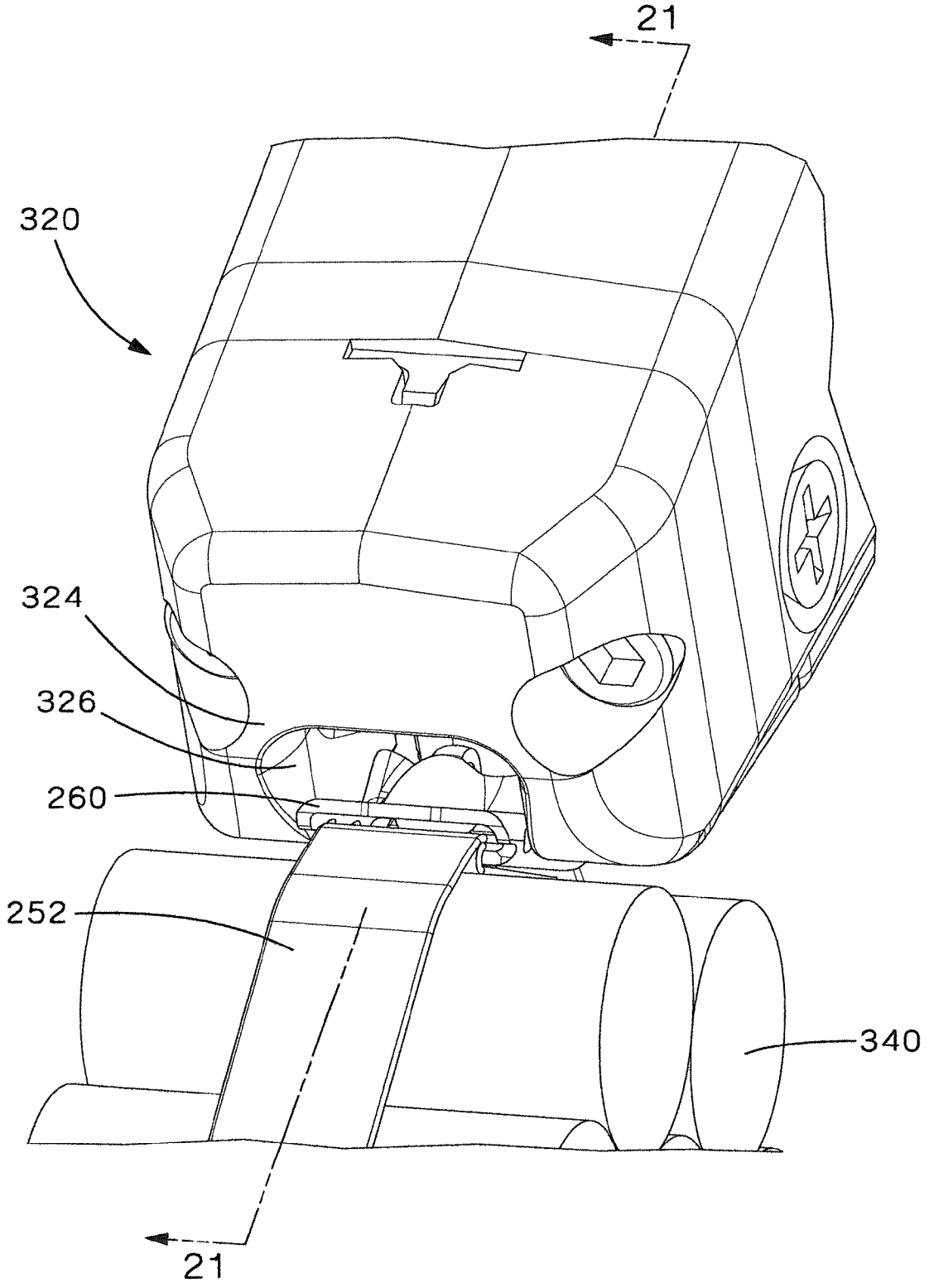
FIG. 20 is a partial perspective view of the metal locking tie head positioned in the guide of the pneumatic hand tool of FIG. 19 and positioned around a bundle.
Figure 21:
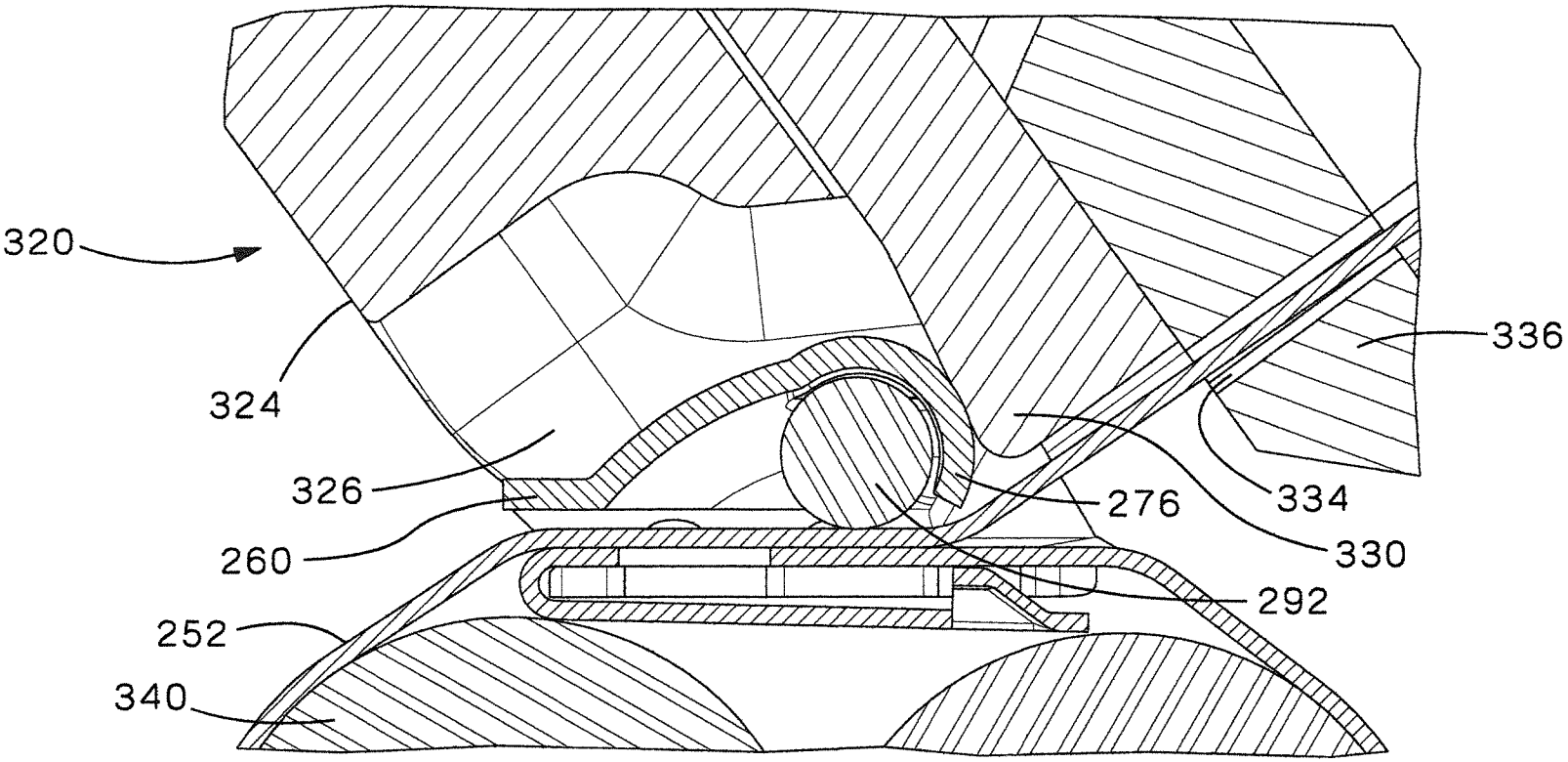
FIG. 21 is a cross sectional view of the metal locking tie positioned in the pneumatic hand tool taken along line 21-21 of FIG. 20.

FIG. 19 illustrates the alternative blade guard housing 322 for the pneumatic hand tool 320. FIGS. 20 and 21 illustrate the pneumatic hand tool 320 engaging the metal locking tie 260 on the top of the bundle 340. The alternative blade guard housing 322 includes a cutter cap 324 with a recessed guide 326 for receiving the ceiling 270 and hood 272 of the metal locking tie head 260. The guide 326 enables the user to control the position of the tie head 260 while the metal locking tie 250 is being installed around a bundle 340. The blade guard housing 322 also includes a ball setter 330, a cutter 332, a slot 334 for receiving the tie body 252, and an anvil 336.

As illustrated in FIGS. 20 and 21, the tie head 260 is positioned within the guide 326. When the tool is activated, the ball setter 330 engages the tab 276 to set the roller means 292 and the cutter 332 is forced downward past the anvil 336 to provide a flush cut off of the tie body 252 as described above.

Furthermore, while the particular preferred embodiments of the present invention have been shown and described, it will be obvious to those skilled in the art that changes and modifications may be made without departing from the teaching of the invention. The matter set forth in the foregoing description and accompanying drawings is offered by way of illustration only and not as limitation.

The invention claimed is:

1. A metal locking tie comprising:

a tie body;

a tie head being secured to the tie body, the tie head having a bottom, a ceiling, a first side, a second side, a strap entrance end and a strap exit end defining a strap receiving passageway therethrough, wherein the strap entrance end having a first width extending between the first side and the second side;

wherein the strap exit end has an angled tool bearing surface adjacent each side of the strap receiving passageway, the strap exit end having a second width extending between the angled tool bearing surfaces, wherein the second width is larger than the first width; and a roller means disposed in the tie head for lockingly engaging the tie body.

2. The metal locking tie of claim 1, wherein the angled tool bearing surface creates an angle with respect to the bottom of the tie head.

3. The metal locking tie of claim 1, wherein the strap exit end is flared for receiving a metal locking tie tool.

4. The metal locking tie of claim 1, wherein the angled tool bearing surface creates a consistent shear surface for a metal locking tie tool to provide a flush cut off of the tie body.

5. The metal locking tie of claim 1, further comprising a hood with ball retainer cutouts that create a linear opening for receiving a metal locking tie tool.

6. The metal locking tie of claim 5, wherein the tie head has a dimple on each side of the hood for creating resistant with the roller means until the tie body is tensioned.

7. The metal locking tie of claim 1, further comprising a hood with a finger and ball retainer cutouts defined by the finger.

8. The metal locking tie of claim 7, wherein the finger is bent vertically downwards for retaining the roller means.

9. The metal locking tie of claim 7, wherein the finger is arced towards a middle of the bottom of the tie head for retaining the roller means.

10. The metal locking tie of claim 1, wherein the bottom further comprising a window.

11. The metal locking tie of claim 1, wherein the bottom further comprising a window and a cut out section, wherein the cut out section extends from the first side to the second side at the strap exit end for receiving a metal locking tie tool.

12. A metal locking tie and a metal locking tie tool for installing the metal locking tie, the combination comprising:

the metal locking tie having a tie body, a tie head secured to the tie body, and a roller means disposed in the tie head for lockingly engaging the tie body; wherein the tie head having a bottom, a ceiling, a first side, a second side, a strap entrance end and a strap exit end defining a strap receiving passageway therethrough, wherein the strap entrance end having a first width extending between the first side and the second side;

wherein the strap exit end has an angled tool bearing surface adjacent each side of the strap receiving passageway, the strap exit end having a second width extending between the angled tool bearing surfaces, wherein the second width is larger than the first width; and the metal locking tie tool having a housing with a cutter cap secured to a front of the metal locking tie tool, a cutter movably positioned within the cutter cap, a ball setter outwardly extending from the cutter, and an anvil;

whereby when the metal locking tie tool has tensioned the metal locking tie, the cutter moves linearly with respect to the cutter cap to set the roller means in the tie head and to provide a flush cut off of an excess tie body from the metal locking tie.

13. The metal locking tie and the metal locking tie tool of claim 12, wherein the housing further comprising a guide for receiving a metal locking tie head.

14. The metal locking tie and the metal locking tie tool of claim 12, wherein the angled tool bearing surface creates an angle with respect to the bottom of the tie head.

15. The metal locking tie and the metal locking tie tool of claim 12, wherein the strap exit end is flared for receiving a metal locking tie tool.

16. The metal locking tie and the meal locking tie tool of claim 12, wherein the angled tool bearing surface creates a consistent shear surface for a metal locking tie tool to provide a flush cut off of the tie body.

17. The metal locking tie and the metal locking tie tool of claim 12, wherein the bottom further comprising a window.

18. The metal locking tie and the metal locking tie tool of claim 12, wherein the bottom further comprising a window and a cut out section, wherein the cut out section extends from the first side to the second side at the strap exit end for receiving a metal locking tie tool.

* * * * *